US008185382B2

(12) United States Patent
Joublin et al.

(10) Patent No.: US 8,185,382 B2
(45) Date of Patent: May 22, 2012

(54) UNIFIED TREATMENT OF RESOLVED AND UNRESOLVED HARMONICS

(75) Inventors: Frank Joublin, Mainhausen (DE); Martin Heckmann, Frankfurt am Main (DE)

(73) Assignee: Honda Research Institute Europe GmbH (DE)

( * ) Notice: Subject to any disclaimer, the term of this patent is extended or adjusted under 35 U.S.C. 154(b) by 569 days.

(21) Appl. No.: 11/142,095

(22) Filed: May 31, 2005

(65) Prior Publication Data

US 2006/0009968 A1 Jan. 12, 2006

(30) Foreign Application Priority Data

Jun. 4, 2004 (EP) ..... 04013274
Aug. 11, 2004 (EP) ..... 04019076

(51) Int. Cl.
*G10L 19/14* (2006.01)
*G10L 11/04* (2006.01)
*G10L 19/00* (2006.01)

(52) U.S. Cl. ..... 704/205; 704/206; 704/207; 704/500

(58) Field of Classification Search ..... 704/205, 704/206, 207, 500
See application file for complete search history.

(56) References Cited

U.S. PATENT DOCUMENTS 3,622,706 A 11/1971 Kalfaian
3,629,510 A 12/1971 Anderson et al.
4,047,108 A 9/1977 Bijker et al.
4,091,237 A 5/1978 Wolnowsky et al.
4,640,134 A 2/1987 Simmons
4,783,805 A 11/1988 Nishio et al.
4,905,285 A 2/1990 Allen et al.
5,136,267 A 8/1992 Cabot
5,214,708 A * 5/1993 McEachern ..... 704/266
5,228,088 A 7/1993 Kane et al.
6,130,949 A * 10/2000 Aoki et al. ..... 381/94.3
6,703,825 B1 * 3/2004 Creek et al. ..... 324/158.1
7,076,433 B2 * 7/2006 Ito et al. ..... 704/500
7,377,233 B2 * 5/2008 Patton ..... 119/712
2002/0133333 A1 * 9/2002 Ito et al. ..... 704/208
2003/0084277 A1 * 5/2003 Przywara et al. ..... 713/1
2007/0083365 A1 * 4/2007 Shmunk ..... 704/232

OTHER PUBLICATIONS

Kaminsky, I.; Materka, A., "Automatic source identification of monophonic musical instrument sounds," Neural Networks, 1995. Proceedings., IEEE International Conference on, vol. 1, No., pp. 189-194 vol. 1, Nov./Dec. 1995.*

(Continued)

*Primary Examiner* — Richemond Dorvil
*Assistant Examiner* — Michael Ortiz Sanchez
(74) *Attorney, Agent, or Firm* — Fenwick & West LLP

(57) ABSTRACT

One embodiment of the present invention provides a post-processing method of a modulation envelope resulting from an interference of two harmonics in a filter band. According to one embodiment, the method comprising filtering the modulation envelope with a band-pass filter bank, wherein a combination of demodulation and application of the band-pass filter on the modulation envelope enables use of identical techniques for resolved and unresolved harmonics.
One embodiment of the present invention provides a method of determining whether a frequency band of an input signal includes unresolved harmonics. According to a further embodiment, in response to a determination that the frequency band includes unresolved harmonics, the method comprises obtaining a modulation envelope of the frequency band by demodulating the frequency band, obtaining one or more frequency bands from the modulation envelope, and determining an evidence value that one of the frequency bands originates from one of fundamental frequencies.

6 Claims, 4 Drawing Sheets

OTHER PUBLICATIONS

E. Vincent, C. Fevotte, R. Gribonval, L. Benaroya, A. R6bel, X. Rodet, F. Bimbot, and E. Le Carpentier, "A tentative typology of audio source separation tasks," in Proc. Int. Symp. ICA and BSS (ICA 03), Nara, Apr. 2003, pp. 715-720.*

De Cheveigne, A., "Pitch Perception Models," To appear in Plack, C. and Oxenham, A. (eds), Pitch, New York, Springer Verlag, 2004.

Hu, G. at al., "Monaural Speech Segregation Based on Pitch Tracking and Amplitude Modulation," IEEE Transactions on Neural Networks, Sep. 2004, pp. 1135-1150, vol. 15, No. 5.

Langner. G. et at., "Frequency and Periodicity are Represented in Orthogonal Maps in the Human Auditory Cortex: Evidence from Magnetoencephalography," Journal of Computational Physiology A, 1997, pp. 665-676.

European Search Report, European Application No. 04017773. Jun. 21, 2005, 4 pages.

European Search Report, European Application No. 04019076, Nov. 19, 2004, 2 pages.

Grossberg, S. et al., "Artstream: A Neural Network Model of Auditory Scene Analysis and Source Segregation," Neural Networks, 2004, pp. 511-536, vol. 17, Elsevier Ltd.

Hu, G. et al., "On Amplitude Modulation for Monaural Speech Segregation," IEEE, 2002, pp. 69-74.

Jinachitra, P., "Constrained EM Estimates for Harmonic Source Separation," IEEE. 2003, pp. VI-609-VI-612.

Virtanen, T. et al., "Separation of Harmonic Sound Sources Using Sinusoidal Modeling," IEEE, 2000, pp. 765-768.

Elghonemy, M. et al., "An Iterative Method for Formant Extraction Using Zero-Crossing Interval Histograms," IEEE Melecon '95, vol. II: Digital Signal Processing, 1985, pp. 155-162.

European Search Report, EP 05004066, Jun. 3, 2005, 5 pages.

Gerhard, D., "Pitch Extractions and Fundamental Frequency: History and Current Techniques," Department of Computer Science, University of Regina, Nov. 2003, pp. 1-22, Regina, Saskatchewan, Canada.

Hess, W., "A Pitch-Synchronous Digital Feature Extraction System for Phonemic Recognition of Speech," IEEE Transactions on Acoustics, Speech, and Signal Processing, Feb. 1976, vol. ASSP-24, No. 1.

Kedem, B., "Spectral Analysis and Discrimination by Zero-Crossings," Proceedings of the IEEE, Nov. 1986, vol. 74, No. 11.

Liu, Y., "A Robust 400-bps Speech Coder Against Background Noise," IEEE, 1991, pp. 601-604.

Ohmura, H., "Fine Pitch Contour Extraction by Voice Fundamental Wave Filtering Method," IEEE, 1994, pp. II-189-II-192.

Park, K-Y. et al., "An Engineering Model of the Masking for the Noise-Robust Speech Recognition," Brain Science Research and Dept. of Electrical Engineering and Computer Science, Korea Advanced Institute of Science and Technology, 2003, 16 pages.

European Examination Report, European Application No. EP 04019076.1, Jul. 19, 2006, 4 pages.

Hu, G. et al., "On Amplitude Modulation for Monaural Speech Segregation," Proceedings of the 2002 International Joint Conference on Neural Networks, IJCNN'02, Honolulu, Hawaii, May 12-17, 2002, International Joint Conference on Neural Networks, New York, NY, IEEE, May 12, 2002, pp. 69-74, vol. 1 of 3.

* cited by examiner

UNIFIED TREATMENT OF RESOLVED AND UNRESOLVED HARMONICS

CROSS-REFERENCE TO RELATED APPLICATIONS

This application is related to and claims priority from European Patent Applications No. 04 013 274.8 filed on Jun. 4, 2004 and 04 019 076.1 filed on Aug. 11, 2004, which are all incorporated by reference herein in their entirety. This application is related to U.S. patent application Ser. No. 11/142,879, filed on May 31, 2005, entitled "Determination of the Common Origin of Two Harmonic Signals" which is incorporated by reference herein in its entirety.

FIELD OF THE INVENTION

The present invention generally relates to the field of signal processing and in particular to the separation of signals from different sources.

BACKGROUND OF THE INVENTION

When making acoustic recordings, often multiple sound sources are present simultaneously. These can be different speech signals, noise (e.g. of fans) or similar signals. For further analysis of the signals it is useful to separate these interfering signals. Separation of signals can be used, for example, for speech recognition or acoustic scene analysis. Harmonic signals can be separated in the human auditory system based on their fundamental frequency. See A. Bregman. *Auditory Scene Analysis*. MIT Press, 1990, which is incorporated by reference herein in its entirety. Note that speech in general contains many voiced and hence harmonic segments.

In conventional approaches the input signal is split into different frequency bands via band-pass filters and in a later stage, for each band at each instant in time, an evidence value for this band to originate from a given fundamental frequency is calculated, where a simple unitary decision can be interpreted as using binary evidence values. By doing so a three dimensional description of the signal is obtained with the following axes: fundamental frequency, frequency band, and time. A similar kind of representation is also found in the human auditory system. See G. Langner, H. Schulze, M. Sams, and P. Heil, The topographic representation of periodicity pitch in the auditory cortex, *Proc. of the NATO Adv. Study Inst. on Comp. Hearing*, pages 91-97, 1998, which is incorporated by reference herein in its entirety.

Based on these beforehand calculated evidence values, groups of bands with common fundamental frequency can be formed. Hence in each group the harmonics emanating from one fundamental frequency and therefore belonging to one sound source are present. By this means the separation of the sound sources can be accomplished.

One problem with conventional approaches is that calculation of an evidence value that a harmonic originates from a given fundamental is especially difficult if the frequency of the harmonic under investigation is high compared to the sampling frequency. If the bandwidth of the band-pass filters used to analyze a signal are chosen such that for high frequencies two or more harmonics fall into one band this filter band shows an amplitude modulation with half the fundamental frequency underlying the harmonics. This effect is also known as unresolved harmonics. See H. Helmholtz, Die Lehre von den Tonempfindungen, Vieweg, Braunschweig, 1863, which is incorporated by reference herein in its entirety.

For low frequencies it is less practicable to design the bandwidth of the filters wide enough to contain at least two harmonics due to the resulting wide bandwidth relative to the center frequency. Hence, under conventional approaches, for low frequencies a different procedure has to be chosen as for high frequencies. Therefore, one problem with conventional approaches is how to combine the results of these two procedures.

FIG. 1 shows a known approach of separating frequency bands, wherein low frequency and high frequency evidence value procedures are applied to the bands based on a threshold frequency $f_T$. This approach chooses the results from one procedure 4 for all bands below a given frequency $f_T$ and take those of the other procedure 5 for all remaining bands. See G. Hu and D. Wang, Monaural speech segregation based on pitch tracking and amplitude. IEEE Trans. On Neural Networks, 2004, which is incorporated by reference herein in its entirety.

What is needed is a more efficient method for separating signal sources, such as acoustic sounds, in an input signal. What is further needed is a way to apply a similar evidence value calculation procedure to both resolved and unresolved harmonics.

SUMMARY OF THE INVENTION

One embodiment of the present invention provides efficient techniques separating signal sources e.g. acoustic sounds in an input signal. A further embodiment of the present invention applies a similar evidence value calculation procedure to both resolved and unresolved harmonics. According to one embodiment, an evidence value reflects whether a harmonic originates from a given fundamental frequency.

One embodiment of the present invention applies a band-pass filter bank to a modulation envelope to get information about harmonics of the modulation envelope. A further embodiment of the present invention provides a post-processing method of a modulation envelope resulting from an interference of two harmonics in a filter band. According to one embodiment, the method comprising filtering the modulation envelope with a band-pass filter bank, wherein a combination of demodulation and application of the band-pass filter on the modulation envelope enables use of identical techniques for resolved and unresolved harmonics.

Another embodiment of the present invention provides a method of evaluating if a given frequency band shows amplitude modulation. One embodiment of the method comprising determining if the frequency band is wide enough to contain two or more harmonics of a fundamental frequency. According to a further embodiment, the method further comprises combining evidence values of one or more frequency bands to originate from a particular fundamental frequency, wherein depending on a result of the determination if the frequency band is wide enough, during fusion an evidence value for a given fundamental frequency, a given frequency band, and a given instant in time is taken either from the procedure working on low or high frequencies. According to one embodiment, the low frequencies comprise resolved harmonics while the high frequencies comprise unresolved harmonics.

One embodiment of the present invention provides a computer program product adapted to implement the techniques of one embodiment of the present invention when running on a computing device. A further embodiment of the present invention provides a computing device designed to perform one or more techniques of the present invention.

According to one embodiment of the present invention, techniques of the present invention are applied to separate acoustic sound sources in monaural recordings based on their underlying fundamental frequencies.

One embodiment of the present invention provides a method of determining whether a frequency band of an input signal includes unresolved harmonics. According to one embodiment, the method comprises obtaining a frequency band from the input signal, and determining whether the frequency band includes unresolved harmonics. According to a further embodiment, determining whether a frequency band includes unresolved harmonics includes evaluating whether the frequency band comprises at least two harmonics of a fundamental frequency. According to another embodiment, determining whether a frequency band includes unresolved harmonics includes evaluating whether the frequency band is wide enough to include at least two harmonics of a fundamental frequency. According to still further embodiment, in response to a determination that the frequency band includes unresolved harmonics, the method further comprises obtaining a modulation envelope of the frequency band by demodulating the frequency band, obtaining one or more frequency bands from the modulation envelope, and determining an evidence value that one of the one or more frequency bands originates from a fundamental frequency.

DETAILED DESCRIPTION OF THE PREFERRED EMBODIMENTS

One embodiment of the present invention provides to a method of separating acoustic sound sources in monaural recordings based on their underlying fundamental frequencies. A further embodiment of the present invention provides for processing of resolved and unresolved harmonics using similar techniques.

One embodiment of the present invention provides techniques for separation of harmonic signals by applying a band-pass filter bank on a modulation envelope, whereby distortions and noise present in the envelope can be reduced significantly. According to a further embodiment, when using non-coherent amplitude demodulation, the modulation envelope includes a fundamental frequency identical to the fundamental frequency of the original input signal, and many harmonics, wherein the non-coherent demodulation results in a doubling in frequency of the envelope.

Figure 1:
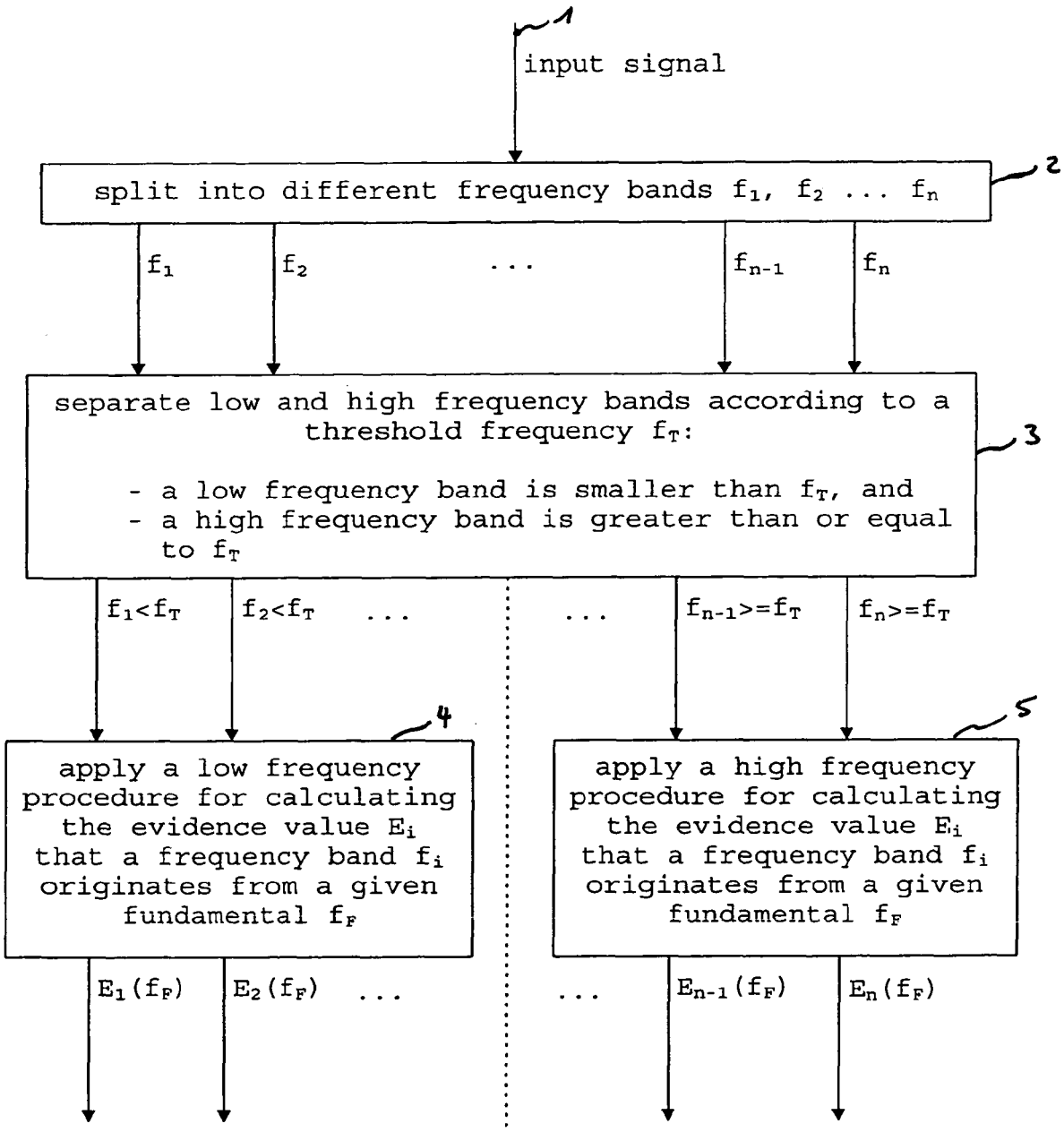
FIG. 1 shows a known method for applying a different evidence value calculation procedure to low and high frequency bands.
Figure 2:
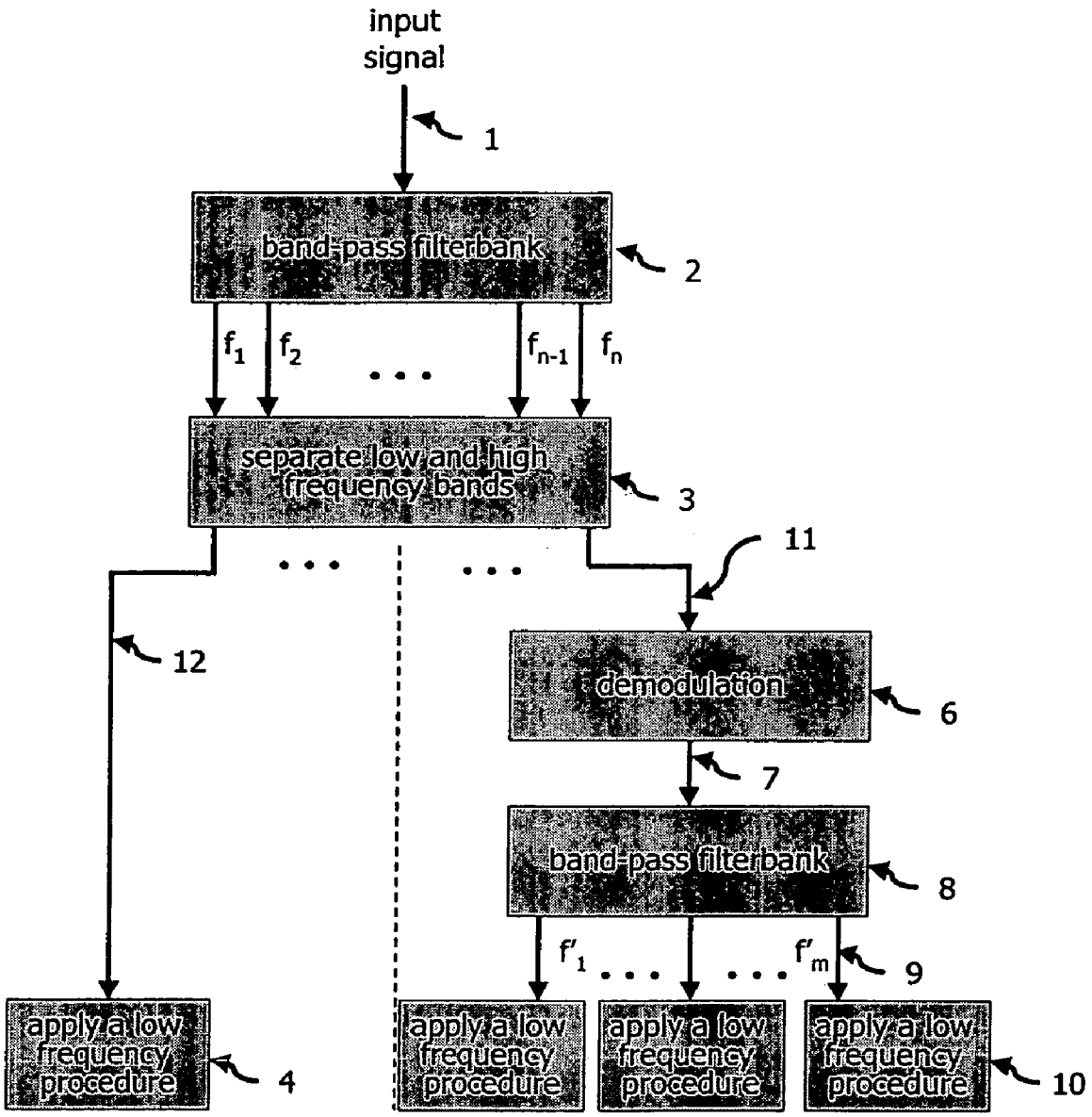
FIG. 2 shows a method of applying the same evidence value calculation procedure to low and high frequency bands, according to one embodiment of the present invention.

FIG. 2 shows a method of applying the same evidence value calculation procedure to low and high frequency bands, according to one embodiment of the present invention. One embodiment of the present invention shown in FIG. 2 processes an input sound signal utilizing the filtered modulation envelope in order to separate the harmonic signals and later on the acoustic sources.

According to one embodiment of the present invention, after having band-pass filtered the input signal 1 into a plurality of n frequency bands $f_1, \ldots, f_n$ with a band-pass filterbank 2, the frequency bands are separated 3 into two categories: low frequency bands 12 and high frequency bands 11. According to one embodiment, low frequency bands 12 contain resolved harmonics and the high frequency bands 11 contain unresolved harmonics.

According to one embodiment of the present invention, low frequency bands 12 are processed by an evidence value calculation procedure adapted to low frequency bands, such as auto-correlation based methods, cross-channel correlation methods or harmonicity based methods. According to a further embodiment, low frequency bands are processed according to techniques discussed in U.S. patent application Ser. No. 11/142,879, filed on May 31, 2005, entitled "Determination of the Common Origin of Two Harmonic Signals".

For evidence value calculation of high frequency bands 11, one embodiment of the present invention makes use of the fact that filter responses of unresolved harmonics are amplitude modulated and that the response envelopes fluctuate at the fundamental frequency of the considered acoustic sound source.

According to one embodiment, a high frequency band 11 is demodulated 6 to get a modulation envelope 7 of the frequency band 11. According to a further embodiment, each high frequency band 11 is demodulated. According to a still further embodiment, modulation envelope 7 is passed to a band-pass filter bank 8 that outputs the frequency bands $f'_1$ to $f'_m$. According to one embodiment, after applying a band-pass filter bank 8 on modulation envelope 7, an evidence value calculation procedure 10 is applied to the obtained frequency bands $f'_1$ to $f'_m$. For example, an identical evidence value calculation procedure 10 as for the low frequencies 12, such as auto-correlation based, can be applied to the obtained frequency bands $f'_1$ to $f'_m$. According to one embodiment of the present invention, the obtained frequency bands $f'_1$ to $f'_m$ are processed by evidence value calculation procedures such as auto-correlation based methods, cross-channel correlation methods or harmonicity based methods. According to a further embodiment the obtained frequency bands $f'_1$ to $f'_m$ are processed according to techniques discussed in U.S. patent application Ser. No. 11/142,879, filed on May 31, 2005, entitled "Determination of the Common Origin of Two Harmonic Signals".

According to one embodiment, band-pass filter banks 2, 8 used for original decomposition of the input signal 1 and filtering 8 of the envelope 7 are similar. According to a further embodiment, band-pass filter banks 2, 8 are identical.

Note that the method according to one embodiment of the present invention shown in FIG. 2 provides increased robustness, inter alia, by taking information contained in harmonics of the modulation envelope 7 into account.

Figure 3:
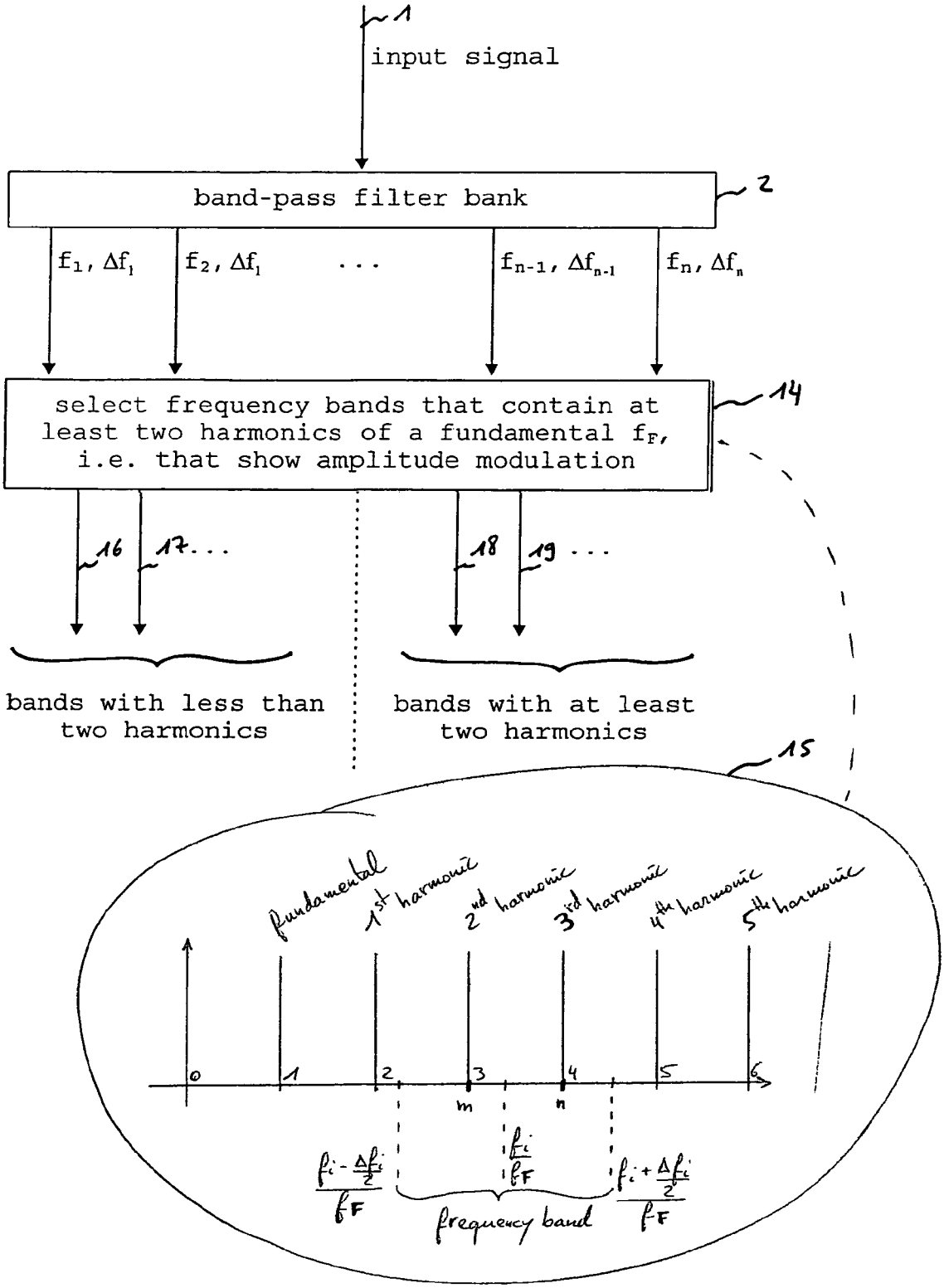
FIG. 3 shows a method of separating frequency bands into low and high frequencies according to one embodiment of the present invention.

FIG. 3 shows a method of separating frequency bands into low and high frequencies according to one embodiment of the present invention. According to one embodiment of the present invention shown in FIG. 3, frequency bands $f_1$ to $f_n$ are separated into two groups of low and high frequencies that include respectively resolved and unresolved harmonics.

According to one embodiment of the present invention, for each fundamental frequency hypothesis knowing the bandwidths of the first analysis filter bank 2 the frequency band which contains at least two harmonics of the fundamental frequency under consideration is calculated. Accordingly, one embodiment of the present invention determines which frequency bands show amplitude modulation and during fusion the evidence values of those frequency bands will be determined by using techniques 6, 8, 10 in FIG. 2 working on the high frequencies. According to a further embodiment, remaining evidence values are determined by using procedure 4 working on the low frequencies.

According to one embodiment, considering a fundamental frequency $f_F$ and a frequency band $f_i$ having a bandwidth $\Delta f_i$, the frequency band contains at least two harmonics of the fundamental frequency if equation (1) below is verified.

$$n-m \geqq 1 \tag{1}$$

According to one embodiment, m and n are integers defined by equations (2) and (3) below.

$$m-1 < \frac{f_i - \frac{\Delta f_i}{2}}{f_F} \leq m \tag{2}$$

$$n \leq \frac{f_i + \frac{\Delta f_i}{2}}{f_F} < n+1 \tag{3}$$

According to a further embodiment of the present invention, the above parameters are shown in an example 15 of FIG. 3, in which an exemplary frequency band includes the second and the third harmonic.

According to one embodiment of the present invention, the integer part [x] of a real argument x is defined according to equation (4) below, and integer n is the integer part of the real value $$\frac{f_i + \frac{\Delta f_i}{2}}{f_F}.$$

$$[x] \leqq x < [x]+1, \tag{4}$$

From equations 2 and 4, according to one embodiment, integer m is the opposite of the integer part of the real value $$-\frac{f_i - \frac{\Delta f_i}{2}}{f_F}.$$

Therefore, according to one embodiment, for the fundamental frequency $f_F$, the frequency band $f_i$ contains at least two harmonics of the fundamental frequency $f_F$ if equation (5) below is true.

$$\left[\frac{f_i + \frac{\Delta f_i}{2}}{f_F}\right] + \left[-\frac{f_i - \frac{\Delta f_i}{2}}{f_F}\right] \geq 1 \tag{5}$$

According to a further embodiment, frequency bands containing at least two harmonics of a given fundamental can be selected 14 by verifying the validity of equation (5) for each frequency band.

According to one embodiment, all bands not fulfilling equation (5) show resolved harmonics and are processed according to a low frequency procedure 4. According to a further embodiment, bands fulfilling equation (5) include unresolved harmonics and are processed by demodulating 6 the envelope 7, band-pass filtering 8 the envelope into frequency bands $f'_1$ to $f'_m$, and applying 10 a procedure for low frequencies to the frequency bands $f'_1$ to $f'_m$.

Figure 4:
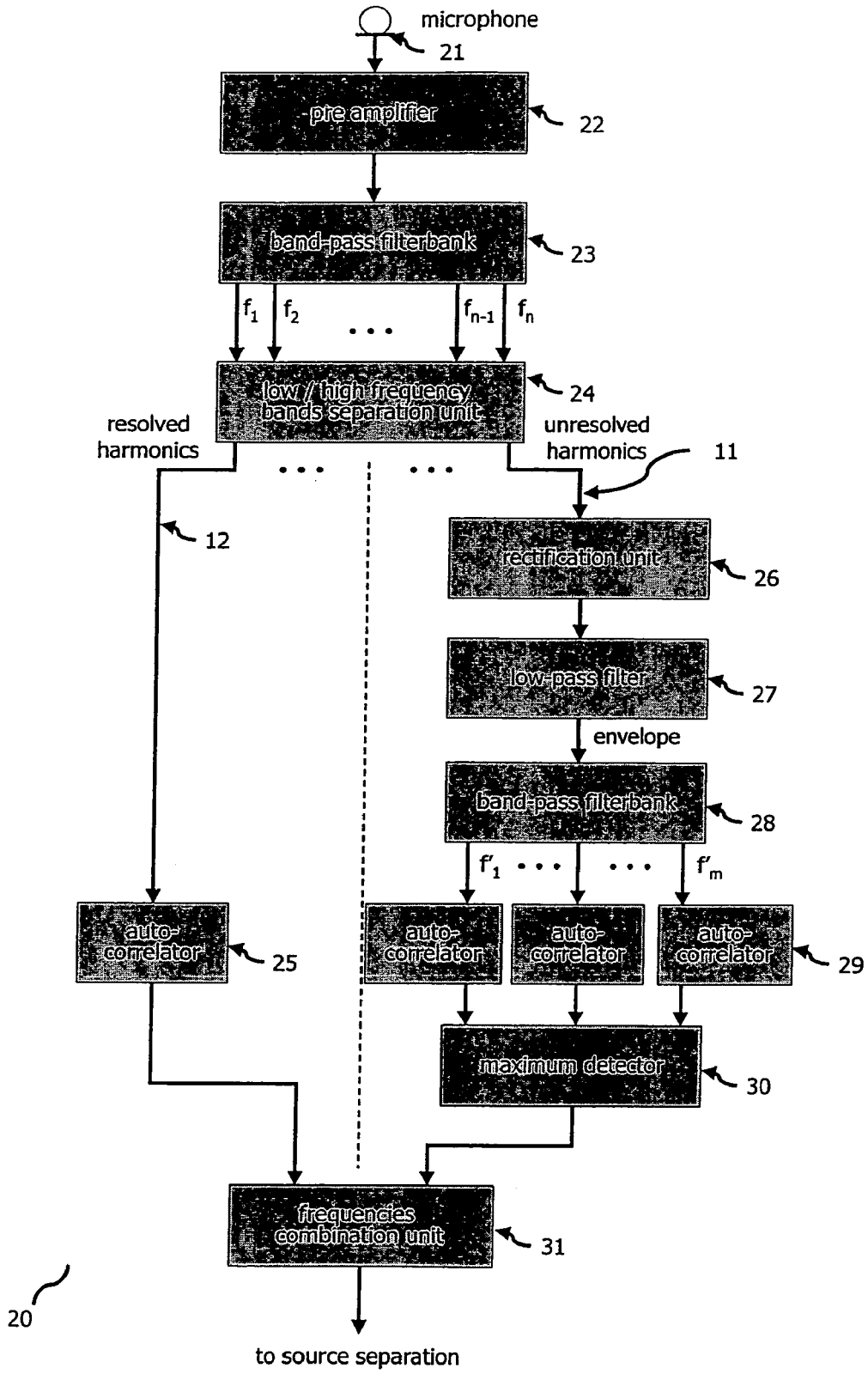
FIG. 4 shows a system for separating acoustic sound sources in monaural recordings according to one embodiment of the present invention.

FIG. 4 shows a system 20 for separating acoustic sound sources in monaural recordings according to one embodiment of the present invention.

According to one embodiment, a sound signal is recorded by a microphone 21 and passed through a pre-amplifier 22. According one embodiment, a band-pass filter bank 23 then generates n frequency bands $f_1$ to $f_n$. For example, the n frequency bands $f_1$ to $f_n$ are different and contiguous. Next, a separation unit 24 separates the resolved 12 and unresolved 11 harmonics.

According to one embodiment, a first group 12 of resolved harmonics, for example each low frequency band, is processed by an auto-correlator 25 to determine an evidence value for this frequency band to originate from a given fundamental frequency. According to another embodiment, auto-correlator 25 can be exchanged with any other unit capable of determining an evidence value for low frequencies to originate from a given fundamental frequency. As shown in FIG. 4, the result of auto-correlator 25 is fed to a frequencies combination unit 31.

According to one embodiment of the present invention, a second group 11 of unresolved harmonics, for example each high frequency band, is processed by a rectification unit 26 and a low-pass filter 27 to generate a modulation envelope 7 of the frequency band 11. Further, envelope 7 is filtered by a band-pass filter bank 28. For example, band-pass filter bank 28 is identical to band-pass filter bank 23. Accordingly, envelope 7 is cut into frequency bands $f'_1$ to $f'_m$ and each band $f'_1$ to $f'_m$ is fed to an auto-correlator 29. According to one embodiment, the result of m auto-correlators 29 is input to a maximum detector 30, whose result is fed to frequencies combination unit 31.

According to one embodiment of the present invention, system 20 includes a frequencies combination unit 31. For example, frequency combination unit 31 has n inputs and 1 output. According to one embodiment, each input is fed with the output of the resolved harmonics processing 25 for a low frequency band 12 or unresolved harmonics processing 26 through 30 for a high frequency band 11. According to another embodiment, frequencies combination unit 31 has two inputs: one input for sequentially feeding the processing results of all low frequency bands and a second input for sequentially feeding the processing results of all high frequency bands. According to one embodiment, output of frequencies combination unit 31 is passed to a device responsible for the effective source separation.

Note that FIGS. 2 and 4 illustrates that, according to one embodiment of the present invention, procedures 4, 10 and units 25, 29 responsible for evidence value calculation are similar for resolved and unresolved harmonics. According to a further embodiment, procedures 4, 10 and units 25, 29 responsible for evidence value calculation are the same for resolved and unresolved harmonics.

The present invention may be embodied in various forms and should not be construed as limited to the embodiments set forth herein. Rather, these embodiments are provided so that disclosure will be thorough and complete and will fully convey the invention to those skilled in the art. Further, the apparatus and methods described are not limited to rigid bodies. While particular embodiments and applications of the present invention have been illustrated and described herein, it is to be understood that the invention is not limited to the precise construction and components disclosed herein and that various modifications, changes, and variations may be made in the arrangement, operation, and details of the methods and apparatuses of the present invention without department from the spirit and scope of the invention as it is defined in the appended claims.

What is claimed is:

1. A computer implemented method for separating sound signals generated from physical sound source devices comprising the steps of:

receiving, by a computer, an input signal representing sounds from a plurality of the physical sound source devices;

band-pass filtering, by a computer, said input signal into a first plurality of frequency bands using a first band-pass filter bank;

separating the frequency bands, by a computer, into one of two categories, wherein the frequency bands of a first category contain resolved harmonics and the frequency bands of a second category contain unresolved harmonics;

applying a first evidence value calculation procedure, by a computer, to frequencies from said first category of frequency;

selecting, by a computer, a frequency bands from said second category of frequency bands;

demodulating, by a computer, each of said selected frequency bands from the second category of frequency bands to obtain a modulation envelope of each of said selected frequency bands from the second category of frequency bands;

applying, by a computer, a second band-pass filter bank to said modulation envelope to obtain a second plurality of frequency bands, wherein said second band-pass filter bank is identical to said first band-pass filter bank;

applying, by a computer, a second evidence value calculation procedure to each of the second plurality of frequency bands, wherein the first and the second evidence value calculation procedures are identical; and grouping bands, by a computer, based on the calculated evidence values, with common fundamental frequencies, wherein in each group the harmonics emanate from one fundamental frequency belonging to one sound source.

2. The method of claim 1, wherein the step of selecting one or more frequency bands from the second category of frequency bands includes the steps of:

identifying a first high frequency band of said one or more frequency bands from the second category of frequency bands; and determining if said first high frequency band is wide enough to contain two harmonics of a fundamental frequency of a frequency in said first high frequency band.

3. The method of claim 2, wherein said determining step comprises determining when $$\left[\frac{f_i + \frac{\Delta f_i}{2}}{f_F}\right] + \left[-\frac{f_i - \frac{\Delta f_i}{2}}{f_F}\right] \geq 1$$

wherein fF is a fundamental frequency and fi is a frequency in said first high frequency band having a bandwidth of Δfi.

4. The method of claim 1, wherein said physical sound source devices include monaural recordings.

5. The method of claim 1, wherein said sounds from the physical sound source devices are converted to first signals representing said sounds from the physical sound source devices and said input signal represents said first signals.

6. The method of claim 1 wherein a value of, or an approximation of, the fundamental frequency of the input signal is not known when receiving said input signal.

* * * * *